US010477653B2

(12) United States Patent
Krajnc et al.

(10) Patent No.: US 10,477,653 B2
(45) Date of Patent: Nov. 12, 2019

(54) NOTIFICATION LIGHTING CONTROL

(71) Applicant: SIGNIFY HOLDING B.V., Eindhoven (NL)

(72) Inventors: Hugo Jose Krajnc, Eindhoven (NL); Remco Magielse, Tilburg (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/770,311

(22) PCT Filed: Oct. 18, 2016

(86) PCT No.: PCT/EP2016/074967
§ 371 (c)(1),
(2) Date: Apr. 23, 2018

(87) PCT Pub. No.: WO2017/067922
PCT Pub. Date: Apr. 27, 2017

(65) Prior Publication Data

US 2018/0317305 A1 Nov. 1, 2018

(30) Foreign Application Priority Data

Oct. 22, 2015 (EP) ..... 15190998

(51) Int. Cl.
*H05B 37/02* (2006.01)
*H05B 33/08* (2006.01)
*G08B 5/00* (2006.01)

(52) U.S. Cl.
CPC ..... *H05B 37/0272* (2013.01); *G08B 5/00* (2013.01); *H05B 33/086* (2013.01); *H05B 37/0281* (2013.01)

(58) Field of Classification Search
None
See application file for complete search history.

(56) References Cited

U.S. PATENT DOCUMENTS

2010/0235309 A1 9/2010 Boleko Ribas et al.
2010/0277106 A1 11/2010 Baaijens
(Continued)

FOREIGN PATENT DOCUMENTS

JP H05144572 A 6/1993
JP 2003159985 A 6/2003
(Continued)

OTHER PUBLICATIONS

Nick T., "How to Change the Notification Colors of Your Phones LED Light," http://www.phonearena.com/news/how-to-change-the-ntofication-colors-of-your-phones-led-lig . . . , posted Mar. 24, 2014 (8 Pages).

*Primary Examiner* — Thomas S McCormack
(74) *Attorney, Agent, or Firm* — Meenakshy Chakravorty

(57) ABSTRACT

A control unit for a lighting system comprising a plurality of light sources, the control unit comprising: an interface for communication with a notification service; a control module configured to: control the plurality of light sources to emit light in accordance with light settings; receive notification light settings that are to be supplied to one or more of the light sources assigned as notification light sources by the notification light settings to provide a visual event notification that are transmitted from the notification service; compare the light settings with the notification light settings; and determine based on said comparison that the light settings and/or the notification light settings are to be modified; and control the one or more notification light sources in accordance with modified notification light settings, and/or control light sources of the plurality of light sources other than notification light sources in accordance with modified light settings.

15 Claims, 6 Drawing Sheets

(56) References Cited

U.S. PATENT DOCUMENTS

| | | | | |
|---|---|---|---|---|
| 2010/0277107 | A1 | 11/2010 | Baaijens et al. | |
| 2014/0266669 | A1 | 9/2014 | Fadell et al. | |
| 2014/0333450 | A1* | 11/2014 | Savage, Jr. | G08B 5/38 340/815.45 |
| 2015/0097680 | A1* | 4/2015 | Fadell | F24F 11/30 340/628 |

FOREIGN PATENT DOCUMENTS

| | | | |
|---|---|---|---|
| WO | 2009150572 | A1 | 12/2009 |
| WO | 2014160519 | A1 | 10/2014 |

* cited by examiner

NOTIFICATION LIGHTING CONTROL

CROSS-REFERENCE TO PRIOR APPLICATIONS

This application is the U.S. National Phase application under 35 U.S.C. § 371 of International Application No. PCT/EP2016/074967, filed on Oct. 18, 2016, which claims the benefit of European Patent Application No. 15190998.3, filed on Oct. 22, 2015. These applications are hereby incorporated by reference herein.

TECHNICAL FIELD

The present disclosure relates to controlling light sources to provide a visual notification of an event.

BACKGROUND

In recent times light emitting diode (LED) based lighting solutions have been developed that provide more capabilities than traditional technologies (e.g. incandescent, compact fluorescent (CFL)). These lighting solutions includes, among others, the possibility of tuning the colour temperature (e.g. from warm white to cool white) and creating a large gamut of colours. For example, the Philips Hue family of products allow for both options: temperature tuning from 2200K to 6500K and around 16 million possible colour combinations.

By enabling external systems to control light sources of a lighting system (in a secure way), it is possible to additionally use lighting in a completely new way; mainly, as a notification tool for different events. Some common implementations of this are for example the interactions between the Philips Hue system and IFTTT (If This Then That), an online service that links different systems in an event-reaction based behaviour, following the format of: "If (event X) happens, then perform (action Y)" where X and Y can be associated with different cloud-based services. A typical use case of this is to allow IFTTT to flash a specific lamp blue when a 3$^{rd}$ party weather forecasting service detects high probability of rain in the coming period. If a user sets this function to a light source close to their home entrance, the user gets a reminder to pick up an umbrella before leaving. Another example is to connect lamps to an external alarm system, such that when an emergency is detected (e.g. smoke in the kitchen), light sources in a user's home flash red.

For this to happen it is necessary that the lighting system (wired or wireless) has a certain level of intelligence or control, such that it can detect the presence of these triggers/events, and can transform them into relevant light settings. In the case of the Philips Hue system this is done by the Hue bridge. The Hue bridge is a small computing device in the user's home that controls the lighting system.

SUMMARY

In the use cases described above, there are two types of light settings in play.

Firstly, the light settings that are chosen by a user to act as a notification (e.g. change to bright blue, flash red at 50% brightness, etc.) of a particular event. These settings define which of the light sources of the lighting system should be controlled to convey the notification. These light settings are only applied when the specific event occurs (also selected by the user), and can last for only a predetermined amount of time or until the user overrides them. These light settings affects only the lamps involved in the notification process. These light settings are referred to herein as "notification light settings".

Secondly, the light settings applied to the light sources of the lighting system just before the notification action occurs. These light settings can involve a larger set of light sources than those that will convey a notification. These light settings are referred to herein as "background light settings".

In known implementations, the notification and background light settings are not linked with each other. This means that upon reception of a trigger the selected light sources will be configured with the notification light settings, regardless of what the background light settings were.

The inventors have identified that if there is not sufficient difference between the notification light settings and the background light settings, the visual notification might be missed by the user i.e. there is not enough change in the light settings that the user perceives the notification.

For example, if the notification light settings involve changing only the brightness of a light source, the relative brightness of this light source with respect to others in the vicinity might impact the noticeability of the change. In another example, if the notification involves changing the colour of light emitted by a light source to a particular colour, this might be easy to detect only if surrounding light sources do not emit light having tones similar to that particular colour in the colour spectrum.

The present disclosure relates to a smart algorithm that by knowing what notification settings are selected and to which light sources, can adapt or adjust the background light settings and/or notification light settings such that the contrast between both sets is enhanced. This allows the user to more easily perceive such notification messages with little impact on the overall lighting ambience.

According to one aspect of the present disclosure there is provided a control unit for use in a lighting system comprising a plurality of light sources, the control unit comprising: an interface for communication with a notification service; and a control module, the control module configured to: control the plurality of light sources to emit light in accordance with light settings; receive, via said interface, notification light settings that are to be supplied to one or more of the plurality of light sources assigned as notification light sources by the notification light settings to provide a visual notification of an event that are transmitted from the notification service; compare the light settings with the notification light settings; and determine based on said comparison that one or more of the light settings and the notification light settings are to be modified; wherein in response to determining that the received notification light settings are to be modified, the control module is configured to modify the received notification light settings to generate modified notification light settings, and control the one or more notification light sources in accordance with the modified notification light settings, and wherein in response to determining that the light settings are to be modified, the control module is configured to modify the light settings to generate modified light settings, and control light sources of the plurality of light sources other than the notification light sources in accordance with the modified light settings.

The control unit may further comprise a memory storing possible light settings associated with each of the plurality of light sources, and the control module may be configured to modify the received notification light settings based on possible light settings associated with the light sources assigned as notification light sources, and modify the light settings based on possible light settings associated with the light sources other than the notification light sources.

The control module may be configured to determine based on said comparison that brightness settings of the notification light settings are to be modified, and in response, modify the brightness settings of the notification light settings to generate the modified notification light settings.

The control module may be configured to determine based on said comparison that brightness settings of the light settings are to be modified, and in response, modify the brightness settings of the light settings to generate the modified light settings. The comparison may comprise comparing the brightness settings of the light settings with the brightness settings of the notification light settings.

The control module may be configured to determine based on said comparison that static colour settings of the light settings are to be modified, and in response, modify the static colour settings of the light settings to generate the modified light settings. The comparison may comprise a colour spectrum comparison of the static colour settings of the light settings and colour settings of the notification light settings.

The control module may be configured to determine based on said comparison that dynamic colour settings of the light settings are to be modified, and in response, modify the dynamic colour settings of the light settings to generate the modified light settings. The comparison may comprise a colour spectrum comparison of the dynamic colour settings of the light settings and colour settings of the notification light settings.

The control unit may be configured to determine based on said comparison that a temporal characteristic of the received notification light settings is to be modified, and in response, modify the temporal characteristic of the notification light settings to generate the modified notification light settings.

The control module may be configured to control the one or more notification light sources in accordance with the modified notification light settings and/or the light sources of the plurality of light sources other than the notification light sources in accordance with the modified light settings, for a predetermined period of time, and upon expiry of the predetermined period of time, the control module is configured to control the plurality of light sources to emit light in accordance with said light settings.

The control module may be configured to control the one or more notification light sources in accordance with the modified notification light settings and/or the light sources of the plurality of light sources other than the notification light sources in accordance with the modified light settings, until an instruction to stop the visual notification is received, and upon receipt of said instruction, the control module is configured to control the plurality of light sources to emit light in accordance with said light settings.

The light settings may be defined by a user and received from a remote device.

The control module may be coupled to a plurality of sensors, and the memory may store location information of each of the plurality of light sources and location information of each of the plurality of sensors, wherein the control module is configured to detect presence and/or motion of a user based on a sensor signal output from a sensor of the plurality of sensors, and modify at least one of the received notification light settings and the light settings in response to said detection.

According to another aspect of the present disclosure there is provided a method for controlling a plurality of light sources of a lighting system comprising, the method comprising: receiving notification light settings that are to be supplied to one or more of the plurality of light sources assigned as notification light sources by the notification light settings to provide a visual notification of an event that are transmitted from a notification service; comparing the light settings with the notification light settings; and determining based on said comparison that one or more of the light settings and the notification light settings are to be modified; wherein in response to determining that the received notification light settings are to be modified, the method further comprising modifying the received notification light settings to generate modified notification light settings, and controlling the one or more notification light sources in accordance with the modified notification light settings, and wherein in response to determining that the light settings are to be modified, the method further comprising modifying the light settings to generate modified light settings, and controlling light sources of the plurality of light sources other than the notification light sources in accordance with the modified light settings.

According to another aspect of the present disclosure there is provided a computer program product for controlling a plurality of light sources of a lighting system, the computer program product comprising code embodied on a computer-readable medium and being configured so as when executed on a processor to: receive notification light settings that are to be supplied to one or more of the plurality of light sources assigned as notification light sources by the notification light settings to provide a visual notification of an event that are transmitted from a notification service; compare the light settings with the notification light settings; and determine based on said comparison that one or more of the light settings and the notification light settings are to be modified; wherein in response to determining that the received notification light settings are to be modified, modify the received notification light settings to generate modified notification light settings, and control the one or more notification light sources in accordance with the modified notification light settings, and wherein in response to determining that the light settings are to be modified, modify the light settings to generate modified light settings, and control light sources of the plurality of light sources other than the notification light sources in accordance with the modified light settings.

These and other aspects will be apparent from the embodiments described in the following. The scope of the present disclosure is not intended to be limited by this summary nor to implementations that necessarily solve any or all of the disadvantages noted.

BRIEF DESCRIPTION OF THE DRAWINGS

For a better understanding of the present disclosure and to show how embodiments may be put into effect, reference is made to the accompanying drawings in which.

DETAILED DESCRIPTION

Embodiments will now be described by way of example only.

Figure 1A:
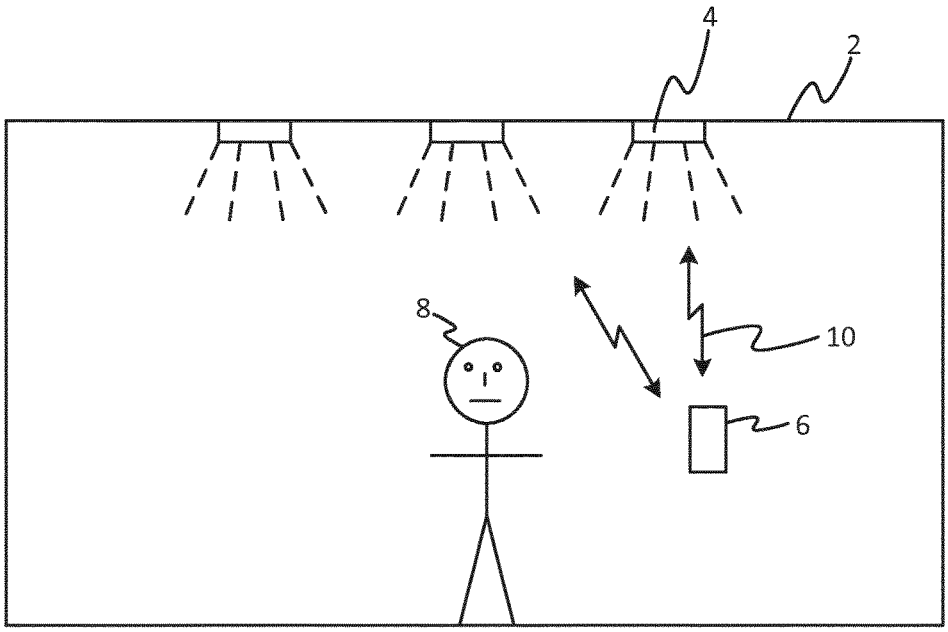
FIGS. 1*a* & 1*b* illustrates a schematic block diagram of a lighting system.
Figure 1B:
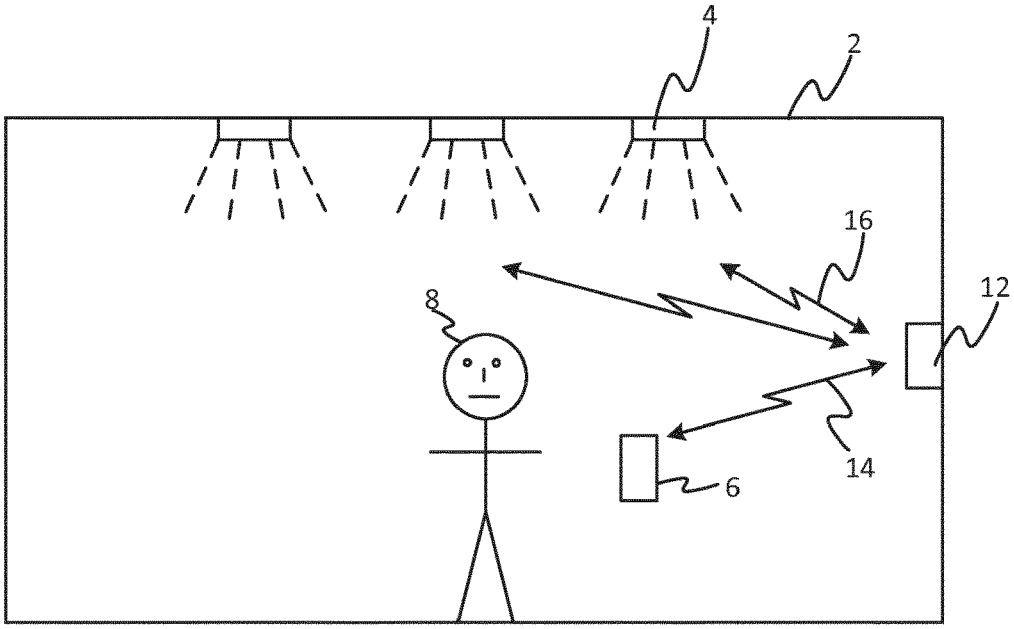

FIGS. 1*a* and 1*b* show examples of a lighting system comprising one or more light sources 4. The lighting system is installed in an environment 2 which may comprise an indoor space such as a room or building, and/or an outdoor space such as a garden or park, and/or a partially-covered environment such as a gazebo or stadium, and/or any other type of environment such as the interior of a vehicle.

One or more luminaire i.e. a device for emitting illumination for illuminating the environment 2 is positioned at locations within the environment 2. Each luminaire comprises one or more light source 4 plus any associated socket, housing and/or support. FIGS. 1*a* and 1*b* show three light sources 4, this is merely an example to illustrate the concepts described herein. It will be appreciated that the three light sources 4 may form a single luminaire, or may each form part of separate luminaries.

Luminaire(s) comprising the light source(s) 4 may be installed at fixed location(s) within the environment 2 (e.g. in the ceiling and/or walls, and/or on light poles fixed to the floor or ground). Alternatively or additionally, the luminaire(s) comprising the light source(s) 4 may be portable (e.g. positioned on a table).

The lighting system further comprises a user interface device 6, such as wall-mounted control panel, or a user terminal such as a mobile user terminal (e.g. smart phone, tablet or laptop) installed with a suitable control application ("app").

The user interface device 6 enables a user 8 to create a static or dynamic lighting scene within the environment 2. For example, in embodiments the user device 6 takes the form of a user terminal running an app through which the user 8 can adjust the colour (spectrum) and/or intensity of the light as a function of space and or time, thereby allowing the user 8 to define various static or dynamic effects to create a desired atmosphere in the environment.

In order to enable the user 8 to control the lighting through the user interface device 6, the user interface device 6 is equipped to communicate with the luminaire(s) and at least to send control signals to the luminaire(s) (directly or indirectly). The user interface device 6 may optionally be equipped to receive signals such as acknowledgments and/or status reports sent back from the luminaire(s).

In the embodiment illustrated in FIG. 1*a*, the communication is implemented via a direct connection 10 between the user interface device 6 and the luminaire(s), which in this context means without the involvement of an intermediate control device of the lighting system such as a lighting bridge. This connection 10 between the user interface device 6 and the one or more fixed light sources may comprise a wired connection, e.g. via an Ethernet, DALI, 0/1-10V or DMX network; and/or wireless connection, e.g. via a short-range RF technology such as Wi-Fi, ZigBee or Bluetooth. For instance, in the case of Wi-Fi, the connection 10 may be via a local Wi-Fi network and hence via a Wi-Fi router disposed in the environment 2 (not shown); or in the case of ZigBee or Bluetooth, the connection 10 may not involve any intermediate router, and may instead for example be based on a mesh network or ad-hoc connection with the luminaire(s).

In contrast with FIG. 1*a*, in the example of FIG. 1*b*, the lighting system does comprises a central control device 12 via which the communication and control is implemented. In the case of a lighting network, this may be referred to as a lighting bridge or just the bridge (without necessarily imply any other limitations that may be associated with the term bridge in the context of other types of network). In the context of the present disclosure the term bridge means that the central control device 12 may translate between network protocols (e.g. Ethernet to Zigbee), this is described in more detail below. In this case, in order to effect control, the user interface device 6 sends control signals to the bridge 12 over a first connection 14, and the bridge sends corresponding control signals to the luminaire(s) over one or more second connections 16. The luminaire(s) may optionally also send signals back to the bridge 12 over the second connection(s) 14, e.g. acknowledgments and/or status reports, and the bridge may send corresponding signals back to the user interface device 6 over the first connection. The first and second connections 14, 16 may take the same form or different forms, and each may take any of the forms discussed in relation to the direct connection 10 in FIG. 1*a* e.g. in one example both the first and second connections 14, 16 are via the same local wireless technology such as Wi-Fi or ZigBee; or in another example, such as in the case of a mobile user device 6 but a wired lighting infrastructure, the first connection 14 (between user device 6 and bridge 12) may be via a local wireless technology such as Wi-Fi or ZigBee, whilst the second connection 16 (between bridge 12 and luminaire(s)) may be via a wired network such as an Ethernet or DMX network.

Note also that the signals over the second connection(s) 16 may be communicated according to the same format, protocol and/or standard as the signals over the first connection 14; or according to a different format, protocol and/or standard. It will therefore be appreciated that where it is said herein that a given signal is communicated from one element to another, or the like, this means the underlying content or meaning is communicated, and does not necessarily limit to the same form of signal being used throughout the communication.

Figure 2:
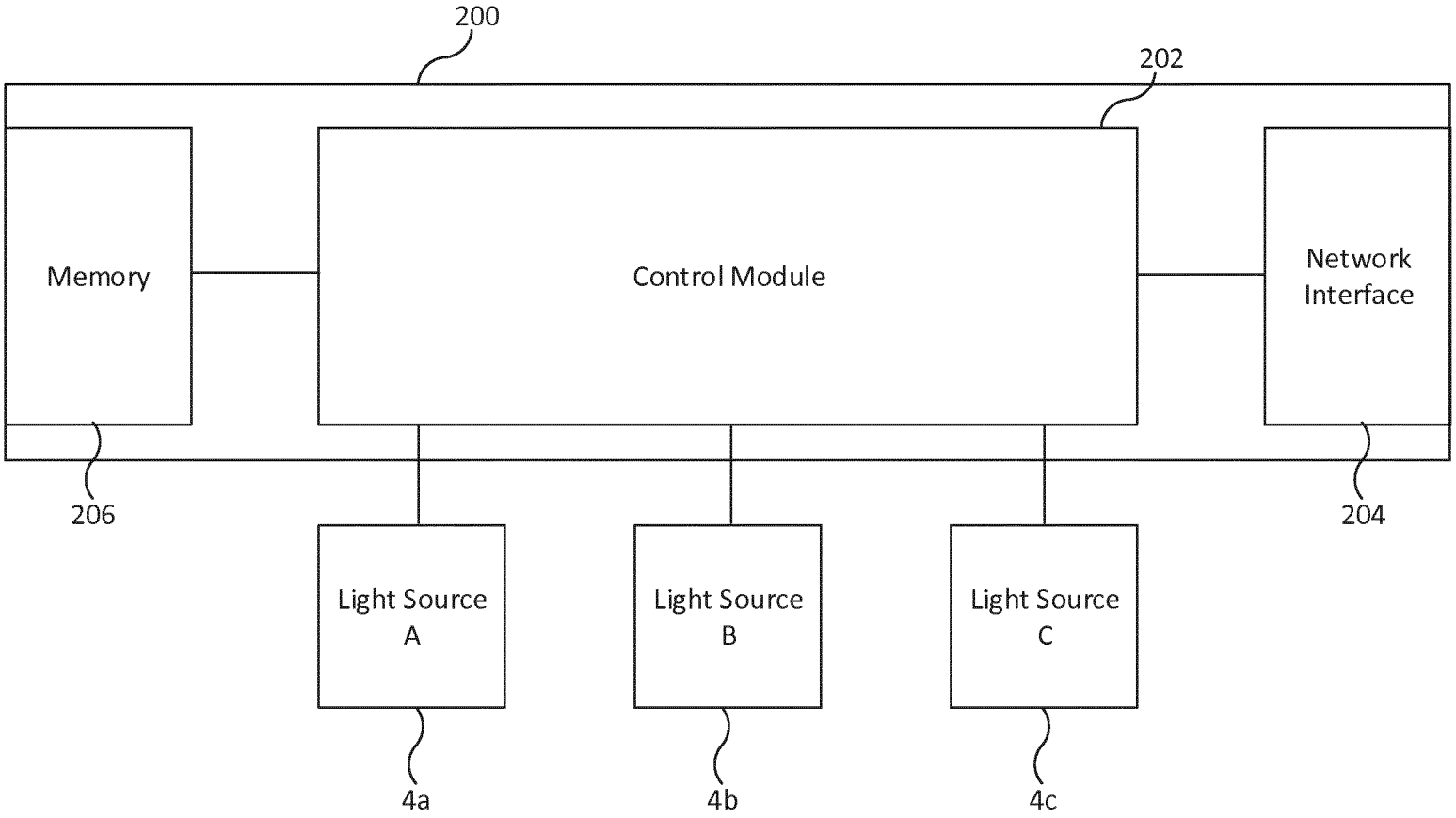
FIG. 2 illustrates a schematic diagram of a control unit and light sources of the lighting system.

In embodiments of the present disclosure, the luminaire(s) are coupled to a control unit 200 which is illustrated in FIG. 2.

As shown in FIG. 2, the control unit 200 comprises a control module 202, a network interface 204 and a memory 206.

The control module 202 is coupled to the one or more luminaire of the lighting system, each luminaire comprising one or more controllable light sources. FIG. 2 illustrates the control module coupled to three light sources, light source A 4*a*, light source B 4*b* and light source C 4*c*. The light sources 4*a*, 4*b*, 4*c* may form part of one or more luminaire of the lighting system. The control module 202 may be coupled to the light sources 4*a*, 4*b*, 4*c* by way of a wired or wireless connection.

The light sources 4*a*, 4*b*, 4*c* are controllable in that a light parameter (intensity, colour, saturation, colour temperature etc.) of the light emitted by the respective light source may be varied by the control module 202. The light sources 4*a*, 4*b*, 4*c* may comprise any suitable source of light such as for example a high/low pressure gas discharge source, a laser diode, an inorganic/organic LED, an incandescent source, or a halogen source. A light source may be a single light source, or could comprise multiple light sources, e.g. multiple LEDs which may, for example, form an array of light sources collectively operating as a single light source.

The memory 206 coupled to the control module 202 is configured to store, for each light source in the lighting system, possible light settings which define the capabilities of the light source. For example the light settings for a particular light source may include a range of brightness (illuminance) values, a range of colour values, a range of saturation values, a range of speeds at which a dynamic light effect can be produced, and/or a range of colour temperature values which can be delivered by the light source when emitting light. It will be appreciated that these possible light settings are merely exemplary and the memory 206 may store additional or alternative possible light settings of the light sources.

The user 8 is able to control the lighting provided by the light sources 4*a*, 4*b*, 4*c* by operating the user interface device 6. In particular the user 8 is able to operate the user interface device 6 to supply background light settings to the control module 202.

In response to receiving these background light settings, the control module 202 is configured to supply the received background light settings to the light sources 4*a*, 4*b*, 4*c* to control them to emit light in accordance with the background light settings. The control module 202 is further configured to store the background light settings in memory 206 such that the memory 206 stores the current light settings that the light sources 4*a*, 4*b*, 4*c* are operating in accordance with.

In the example of FIG. 1*a*, the user interface device 6 transmits the background light settings via connection 10 which as described above may be a wired or wireless connection. In the example of FIG. 1*b*, the control unit 200 is implemented on the bridge 12 and the user interface device 6 transmits the background light settings via connection 14 which as described above may be a wired or wireless connection. In this embodiment, the control module 202 receives the background light settings via the network interface 204 and supplies the background light settings to the light sources 4*a*, 4*b*, 4*c* using connection 16.

The network interface 204 couples the control unit 200 to a notification service. The control unit 200 may be coupled to the notification service directly or indirectly (e.g. via the bridge 12). The notification service links the lighting system with one or more external system. The user 8 can register with the notification service and choose notification light settings which should be transmitted to the control unit 200 when an event occurs in the external system, such that the control module 202 will control one or more light sources (assigned as notification light sources by the notification light settings) to provide a visual notification of the event to the user 8. That is, the user 8 selects via the notification service the possibility to change the light settings of a subset of the light sources based on events that he/she cannot directly control and for which he/she would like to receive a notification. The user 8 may interact with the notification service via a web browser running on the user interface device 6 or a software application associated with the notification service executed on the user interface device 6.

The notification service operates in accordance with an event-reaction based behaviour, following the format of: "If (event X) happens, then perform (action Y)". The external system(s) linked to the lighting system may comprise for example an email system (e.g. if the user 8 receives an email from a specific address then blink light source all of the light sources 4*a*, 4*b*, 4*c*), a weather system (e.g. if the probability of rain is high then flash light source A 4*a*, that is located to the entrance of the user's home, blue so the user gets a reminder to pick up an umbrella before leaving), an alarm system (e.g. when an emergency is detected such as smoke in the kitchen of the user's home flash the light sources 4*a*, 4*b*, 4*c* red). It will be appreciated that the external systems referred to above are merely examples to illustrate the concept and the lighting system may be linked with many more types of external systems not discussed herein.

In contrast with known systems, in embodiments of the present disclosure the control module 202 does not merely supply the received notification light settings to light sources assigned to provide a visual indication of the notification by the notification light settings.

In embodiments of the present disclosure the control module 202 implements an algorithm which determines whether the light emitted by notification light sources in accordance with the received notification light settings will provide sufficient contrast to the light emitted by the background light sources (the light sources not assigned as notification light sources by the notification light settings, and thus emitting light in accordance with background light settings).

Based on the list of available light sources and their possible and current light settings (stored in memory 206), and knowledge of the selected notification light settings, the control module 202 can update, improve, or correct the light settings of either background light sources, notification light sources, or both such that the integral effect provided by the light sources in the lighting system resembles a previously determined set of configuration options but with enhanced contrast between the two sets of light settings.

Figure 3:
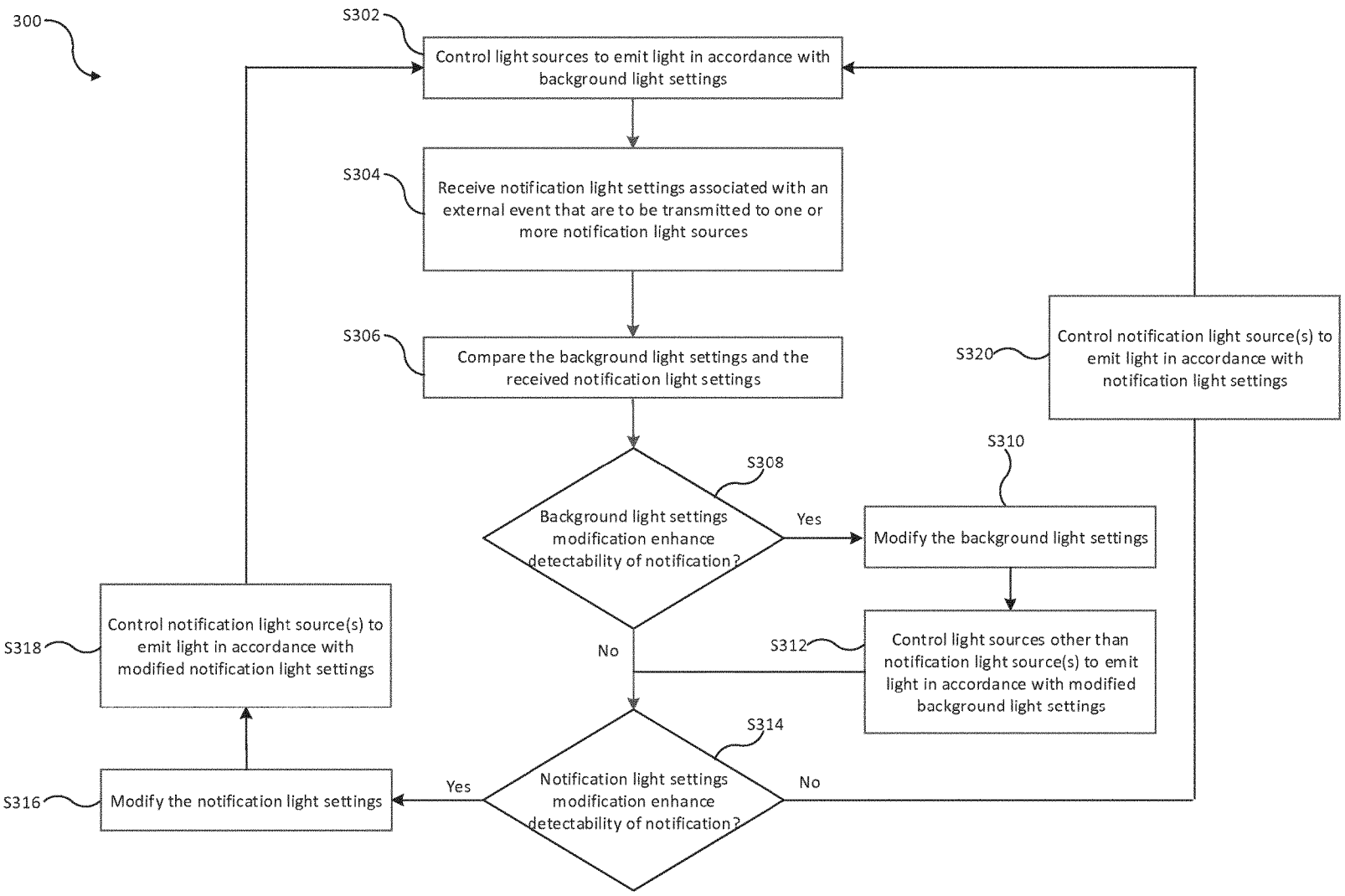
FIG. 3 is a flow chart of a process performed by the control unit for controlling the light emitted by the light sources.

To describe the operation of the control module 202 in more detail, reference is now made to FIG. 3 which is a flowchart for a process 300 performed by the control module 202.

At step S302, the control module 202 supplies background light settings received from the user interface device 6 to the light sources 4*a*, 4*b*, 4*c* to control them to emit light in accordance with the background light settings. Following step S302, the light sources 4*a*, 4*b*, 4*c* are operating as background light sources in that they are providing a static or dynamic lighting effect to create a desired atmosphere in the environment 2 of the user 8.

In response to an event occurring in an external system for which the user 8 has selected to receive a notification for, the notification service is operable to transmit notification light settings that are associated with the event (selected by the user 8) to the control unit 200.

Thus at step S304, the control module 202 receives, via the network interface 204, the notification light settings that are to be supplied to one or more of the light sources 4*a*, 4*b*, 4*c* that are assigned as notification light sources by the notification light settings to provide a visual notification of the event. For example, the notification light settings may define that light source C 4*c* should provide the visual notification of the event, and define the light settings which should be supplied to light source C 4*c* to provide the visual notification.

At step S306, the control module 202 compares the background light settings that the background light sources (e.g. light source A 4*a* and light source B 4*b*) will emit light in accordance with, and the notification light settings that the notification light source (e.g. light source C 4*c*) will emit light in accordance with.

The control module 202 performs the comparison to determine whether sufficient contrast will be provided between the light emitted by the background light sources and the light emitted by the notification light sources.

If the control module 202 determines that a sufficient contrast will not be provided between the light emitted by the background light sources and the light emitted by the notification light sources, the control module 202 is able to determine using the possible light settings of the light sources 4*a*, 4*b*, 4*c* stored in memory 206 that the background light settings and/or the notification light settings can be modified to enhance the detectability of the visual notification provided by the notification light sources.

If the control module 202 determines at step S308 that the possible light settings of the background light sources allow modification of the background light settings that will enhance the contrast between the light emitted by the background light sources and the light emitted by the notification light sources, the process 300 proceeds to step S310 whereby the control module 202 modifies the background light settings and controls the background light sources to emit light in accordance with the modified background light settings by transmitting the modified background light settings to the background light sources at step S312. The process 300 then proceeds to step S314.

If the control module 202 determines at step S308 that modification to the background light settings is not possible to enhance the contrast between the light emitted by the background light sources and the light emitted by the notification light sources, the process 300 proceeds to step S314.

If the control module 202 determines at step S314 that the possible light settings of the notification light sources allow modification to the received notification light settings that will enhance the contrast between the light emitted by the background light sources and the light emitted by the notification light sources, the process 300 proceeds to step S316 where the control module 202 modifies the received notification light settings and controls the notification light sources to emit light in accordance with the modified notification light settings by transmitting the modified notification light settings to the notification light sources at step S318.

If the control module 202 determines at step S314 that modification to the received notification light settings is not possible to enhance the contrast between the light emitted by the background light sources and the light emitted by the notification light sources, the process 300 proceeds to step S320 where the control module 202 controls the notification light sources to emit light in accordance with the received notification light settings by transmitting the received notification light settings to the notification light sources The control module 202 controls the notification light sources to emit light in accordance with the received notification light settings (at step S320) or modified notification light settings (at step S318) for a predetermined time period or until the control module 202 receives an instruction transmitted from the user interface device 6 to stop the visual notification, after which the control module 202 controls the notification light sources to emit light in accordance with the background light settings applied immediately prior to receipt of the notification light settings.

The instruction does not have to be transmitted from the user interface device 6, for example the instruction may be received in response to the user 8 interacting with a local input device (e.g. button or other interface) on the luminaire(s) comprising the notification light sources. Alternatively, the instruction may correspond to further notification light settings associated with a further event (it is not necessarily the user 8 which stops a visual notification of an event).

Similarly, the control module 202 controls the background light sources to emit light in accordance with the modified background light settings (at step S312) for the predetermined time period or until the control module 202 receives the instruction to stop the visual notification, after which the control module 202 controls the background light sources to emit light in accordance with the background light settings applied immediately prior to receipt of the notification light settings.

Modification of the background light settings and/or the notification light settings performed by the control module 202 may be implemented in various ways which are described in more detail below.

In one embodiment, the control module 202 may determine based on the comparison at step S306 that brightness settings of the background light settings are to be modified, and in response, modify the brightness settings of the background light settings to generate modified background light settings (at step S310). Similarly, the control module 202 may determine based on the comparison at step S306 that brightness settings of the notification light settings are to be modified, and in response, modify the brightness settings of the notification light settings to generate the modified notification light settings (at step 316).

For example, the control module 202 may control the light sources 4*a*, 4*b*, 4*c* in accordance with background light settings which define that the light sources 4*a*, 4*b*, 4*c* should emit light of the same colour and of the same brightness.

The control module 202 may receive, via the network interface 204, notification light settings which assign light source 4*c* as a notification light source to provide a visual notification of an external event and define light settings to control light source C 4*c* to emit flashing light (e.g. to increase the brightness of the light emitted by light source C 4*c* for a predetermined amount for a period of time and then decrease the brightness of the light emitted by light source C 4*c* for a predetermined amount period of time, in a repetitive fashion) to provide the visual notification.

Figure 4A:
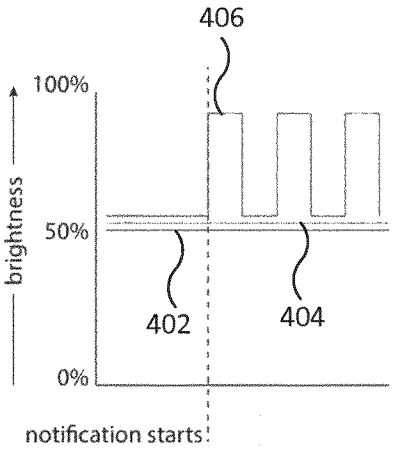
FIGS. 4*a*-4*d* illustrate how adjustment of lights settings applied to the light sources may be implemented.

A control module operating in accordance with known solutions would supply the received notification light settings to light source C 4*c* without any regard to the light emitted by background light sources. This scenario is illustrated in FIG. 4*a* which illustrates the brightness of the light 402 emitted by light source A 4*a*, the brightness of the light 404 emitted by light source B 4*b*, and the flashing light 406 emitted by light source C 4*c*.

In accordance with embodiments of the present disclosure, when the control module 202 is informed that this notification setting should be applied, the control module 202 compares the brightness levels of the light 402 emitted by light source A 4*a*, the light 404 emitted by light source B 4*b* and the increased level of light 406 emitted by light source C 4*c* defined by the notification light settings. If the difference between the increased brightness level of light 406 emitted by light source C 4*c* and the brightness level of light 402 emitted by light source A 4*a* and the brightness level of light 404 emitted by light source B 4*b* is greater than or equal to a predetermined threshold, the control module 202 will not modify either of the background light settings applied to light source A 4*a* and light source B 4*b*, or the notification light settings which are to be supplied to light source C 4*c*.

The predetermined threshold may be configurable, for example the predetermined threshold may be configured by the user 8 using the user interface device 6. Alternatively, the control module 202 may determine the threshold. For example the control module 202 may determine the threshold based on the number of notification light sources compared with the number of background light sources. Alternatively or additionally, the control module 202 may determine the threshold based on contextual information such as weather information, time of day etc.

If the difference between the increased brightness level of light 406 emitted by light source C 4*c* and the brightness level of light 402 emitted by light source A 4*a* and the brightness level of light 404 emitted by light source B 4*b* is less than the predetermined threshold, then the control module 202 modifies brightness settings of the background light settings and/or the notification light settings to make the change of brightness of the light emitted by light source C 4*c* stand out from the background light level set by light source A 4*a* and light source B 4*b*. This can be done in various ways in dependence on the possible light settings of each of the light sources 4*a*, 4*b*, 4*c* which are stored in memory 206.

Figure 4B:
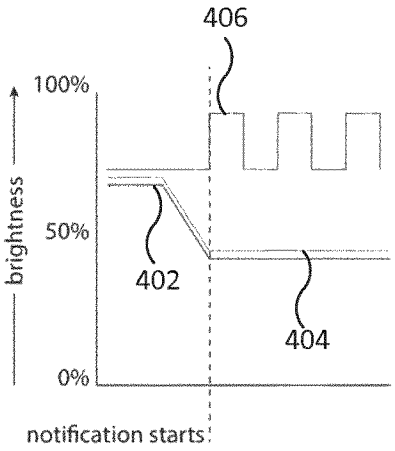

As shown in FIG. 4*b*, the control module 202 may determine to modify the brightness settings of the background light settings that are applied to light source A 4*a* and light source B 4*b* to decrease the brightness of the light 402 emitted by light source A 4*a* and the light 404 emitted by light source B 4*b*, and supply the received notification light settings to light source C 4*c* without making any modification to them.

Figure 4C:
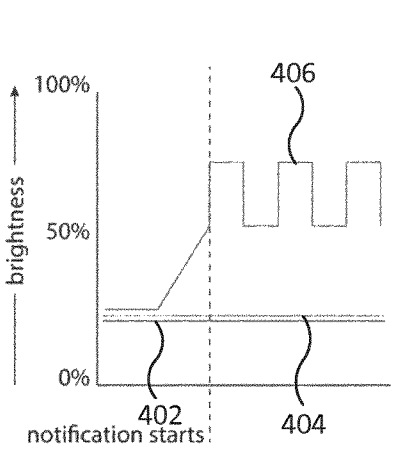

As shown in FIG. 4*c*, the control module 202 may determine to modify brightness settings of the received notification light settings to increase the brightness of the light 406 emitted by light source C 4*c* prior to commencement of the light source C 4*c* emitting flashing light, and make no modification to the background light settings that are applied to light source A 4*a* and light source B 4*b*.

Figure 4D:
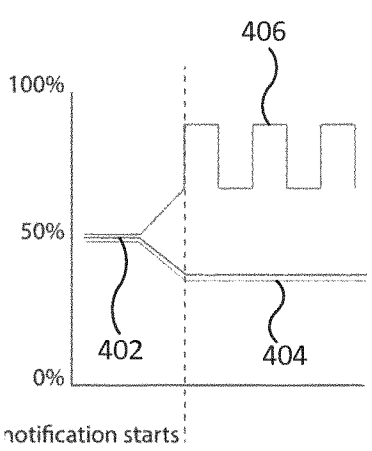

As shown in FIG. 4*d*, the control module 202 may determine to modify brightness settings of the background light settings that are applied to light source A 4*a* and light source B 4*b* to decrease the brightness of the light 402 emitted by light source A 4*a* and the light 404 emitted by light source B 4*b*, and also modify brightness settings of the received notification light settings to increase the brightness of the light 406 emitted by light source C 4*c* prior to commencement of the light source C 4*c* emitting flashing light.

In another embodiment, the control module 202 may determine based on the comparison at step S306 that static colour settings (not time varying) of the background light settings are to be modified, and in response, modify the static colour settings of the background light settings to generate the modified light settings (at step S310).

For example, the control module 202 may control the light sources 4*a*, 4*b*, 4*c* in accordance with background light settings which define that the light sources 4*a*, 4*b*, 4*c* should emit light with different colours but at the same brightness level.

The control module 202 may receive, via the network interface 204, notification light settings which assign light source 4*c* as a notification light source to provide a visual notification of an external event and define light settings to control light source C 4*c* to emit blue light periodically (e.g. to change the colour of the light emitted by light source C 4*c* to blue for a predetermined amount for a period of time and then reverse the colour change for a predetermined period of time, in a repetitive fashion) to provide the visual notification.

In accordance with embodiments of the present disclosure, when the control module 202 is informed that this notification setting should be applied, the control module 202 compares the colours of the light emitted by each of light source A 4*a*, light source B 4*b*, and the colour of the light emitted that will be emitted by light source C 4*c* in accordance with the received notification settings, from a spectral point of view (performs a colour spectrum comparison of the light emitted by the light sources 4*a*, 4*b*, and 4*c*). To compute the difference in colour, the control module 202 may compare the Hue values, or XY values, based on the colour model used. If the difference between those values is lower than a given threshold it may decide that the colours are too much alike. This threshold may be adjusted to match sensitivity of the human eye to certain colours, so that for some colours the difference needs to be larger than for others.

If the control module 202 determines that the colour difference between the colour of light that will be emitted by light source C 4*c* and the colour of light emitted by light source A 4*a* and the colour of light emitted by light source B 4*b* provides a sufficient contrast, the control module 202 will not modify the background light settings applied to light source A 4*a* and light source B 4*b*.

Figures 5A, 5B, 5C:
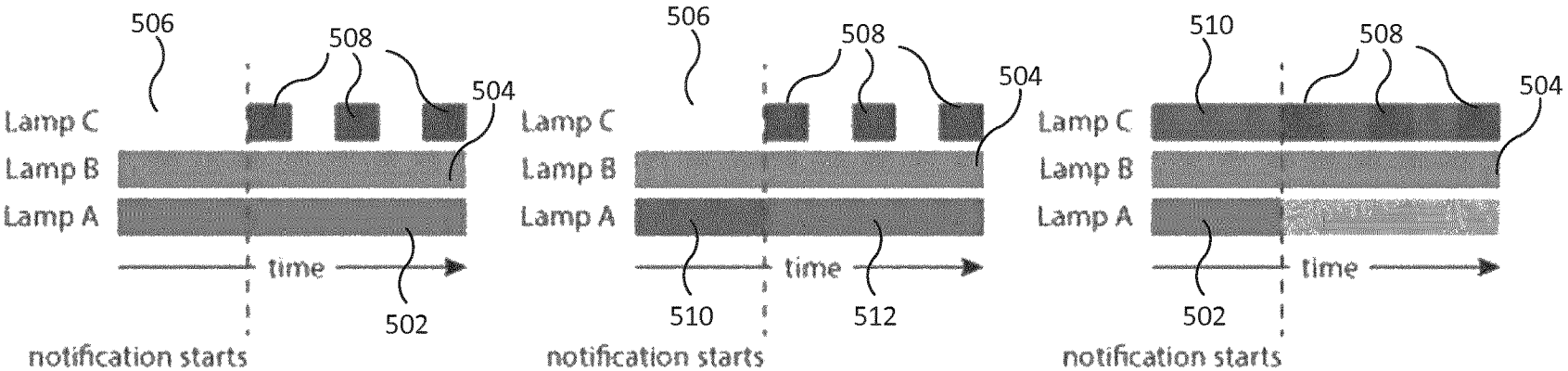
FIGS. 5*a*-5*c* illustrate how adjustment of lights settings applied to the light sources may be implemented.

For example, with reference to FIG. 5*a*, if light source A 4*a* emits red light 502, light source B 4*b* emits green light 504, and light source C 4*c* emits yellow light 506, the control module 202 may determine that periodically changing the light emitted from light source C 4*c* from yellow light 506 to blue light 508 while the light emitted by light source A 4*a* remains red and the light emitted by light source B 4*b* remains green provides sufficient contrast such that the visual notification will be visible to the user 8, and thus no modification to the background light settings are required.

However if the control module 202 determines that the colour difference between the colour of light that will be emitted by light source C 4*c* and the colour of light emitted by light source A 4*a* and the colour of light emitted by light source B 4*b* does not provides a sufficient contrast, the control module 202 will modify the background light settings applied to light source A 4*a* and light source B 4*b*.

For example, with reference to FIG. 5*b*, if light source A 4*a* emits violet light 510, light source B 4*b* emits green light 504, and light source C 4*c* emits yellow light 506, the control module 202 may determine that periodically changing the light emitted from light source C 4*c* from yellow light 506 to blue light 508 while the light emitted by light source A 4*a* remains violet will not provide sufficient contrast, and in response may modify the colour settings of the background light settings that are applied to light source A 4*a* to move the colour of light emitted by light source A 4*a* away from the violet tones in the colour spectrum and closer to the red tones in the colour spectrum, such that contrast with the light emitted by light source C 4*c* increases. This modified colour of the light emitted by light source A 4*a* is represented as numeral 512 in FIG. 5*b*.

In another example, with reference to FIG. 5*c*, if light source A 4*a* emits red light 502, light source B 4*b* emits green light 504, and light source C 4*c* emits violet light 510, the control module 202 may determine that periodically changing the light emitted from light source C 4*c* from violet light 510 to blue light 508 while the light emitted by light source A 4*a* remains red and the light emitted by light source B 4*b* remains green, will not provide sufficient contrast. In this example, instead of changing the colour of light emitted by the background light sources, the control module 202 may modify the brightness settings of the light sources 4*a*, 4*b*, and 4*c* in accordance with any of the brightness level setting modifications described above to enhance the detectability of the visual notification provided by the light emitted from light source C 4*c*.

In another embodiment, the control module 202 may determine based on the comparison at step S306 that dynamic colour settings (time varying) of the background light settings are to be modified, and in response, modify the dynamic colour settings of the background light settings to generate the modified light settings (at step S310).

For example, the control module 202 may control the light sources 4*a*, 4*b*, 4*c* in accordance with background light settings which define that the light sources 4*a*, 4*b*, 4*c* should emit light to produce a disco effect (e.g. fast flashing and blinking of different colours). That is, the background light settings comprise a number of time-varying effects (colour and brightness) for light sources 4*a*, 4*b*, 4*c*.

The control module 202 may receive, via the network interface 204, notification light settings which assign light source 4*c* as a notification light source to provide a visual notification of an external event and define light settings to control light source C 4*c* to emit red light periodically (e.g. to emit red light for a predetermined amount for a period of time and then emit no light for a predetermined period of time, in a repetitive fashion) to provide the visual notification.

In this case the control module 202 can proactively decide to modify the colours and/or brightness levels of one or more of the light sources 4*a*, 4*b*, 4*c* so that these background time-varying settings are not mistaken for those belonging to the notification effect, or so that if needed the adjustments needed to enhance detectability are minimized.

In accordance with embodiments of the present disclosure, when the control module 202 is informed that this notification setting should be applied, the control module 202 compares the colours of the light emitted by each of light source A 4*a* and light source B 4*b* defined by the dynamic colour settings of the background light settings, and the colour of the light emitted that will be emitted by light source C 4*c* in accordance with the received notification settings, from a spectral point of view (performs a colour spectrum comparison of the light emitted by the light sources 4*a*, 4*b*, and 4*c*).

If the control module 202 determines that the colour difference between the colour of light that will be emitted by light source C 4*c* and the colours of light emitted by light source A 4*a* and light source B 4*b* provides a sufficient contrast, the control module 202 will not modify the background light settings applied to light source A 4*a* and light source B 4*b*.

However if the control module 202 determines that the colour difference between the colour of light that will be emitted by light source C 4*c* and the colours of light emitted by light source A 4*a* and light source B 4*b* does not provides a sufficient contrast, the control module 202 will modify the background light settings applied to light source A 4*a* and light source B 4*b*.

For example, the control module 202 may modify the dynamic colour settings of the background light settings that are applied to light source A 4*a* and light source B 4*b* such that the colour(s) (e.g. red) used to provide the visual notification of the event is skipped (the light sources A 4*a* and light source B 4*b* do not emit red light as part of the disco effect) to avoid confusion.

Alternatively the control module 202 may modify the dynamic colour settings of the background light settings that are applied to light source A 4*a* and light source B 4*b* to reduce the speed of the disco effect (slowly fade through colours instead of rapid flashing). In this example, the control module 202 may also decrease the brightness of the light producing the disco effect (the light emitted by light source A 4*a* and the light emitted by light source B 4*b*)

In another example, the control module 202 may control the light sources 4*a*, 4*b*, 4*c* in accordance with background light settings which define that the light sources 4*a*, 4*b*, 4*c* should emit light which sequentially cycles through the colours of the rainbow That is, the background light settings comprise a time-varying colour effect for light sources 4*a*, 4*b*, 4*c*.

The control module 202 may receive, via the network interface 204, notification light settings which assign light source 4*c* as a notification light source to provide a visual notification of an external event and define light settings to control light source C 4*c* to emit blue light to provide the visual notification.

In this example, the control module 202 will determine that the colour difference between the colour of light that will be emitted by light source C 4*c* and the colours of light emitted by light source A 4*a* and light source B 4*b* does not provides a sufficient contrast (as light sources 4*a* and 4*b* will also emit blue light as they cycle through the colours of the rainbow), and modify the background light settings applied to light source A 4*a* and light source B 4*b*.

The control module 202 may modify the dynamic colour settings of the background light settings that are applied to light source A 4*a* and light source B 4*b* such that the light sources emit light having a colour which is not blue but close to blue on the colour spectrum (e.g. violet tones) to ensure that should the notification light source (light source C 4*c*) go blue it will not be confused for being part of the sequence of colours in the rainbow effect.

Alternatively, the control module 202 may modify the dynamic colour settings of the background light settings so that the current temporal quality of the rainbow effect is slowed down at a colour that is contrasting to the notification colour such that the notification stands out.

Figure 6B:
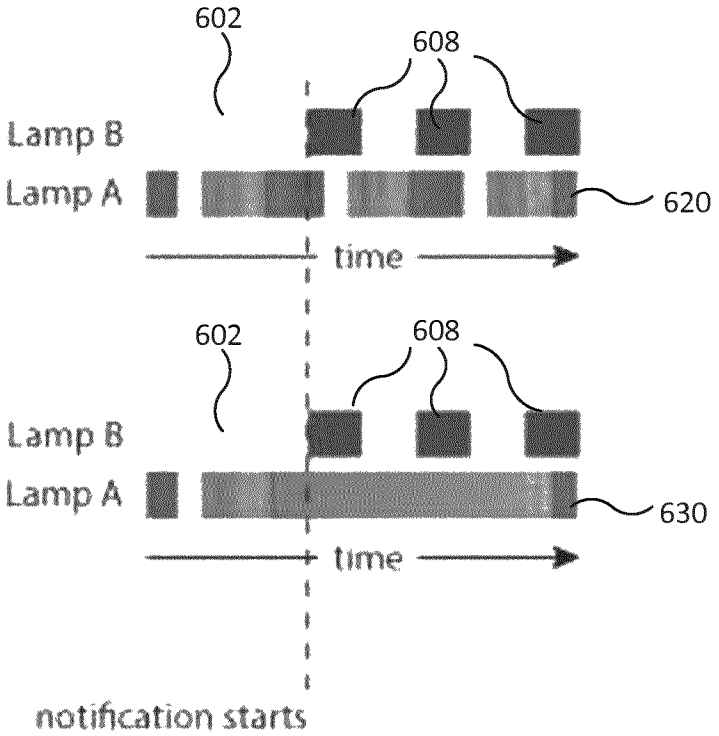
FIGS. 6*a* & 6*b* illustrate how adjustment of lights settings applied to the light sources may be implemented.
Figure 6A:
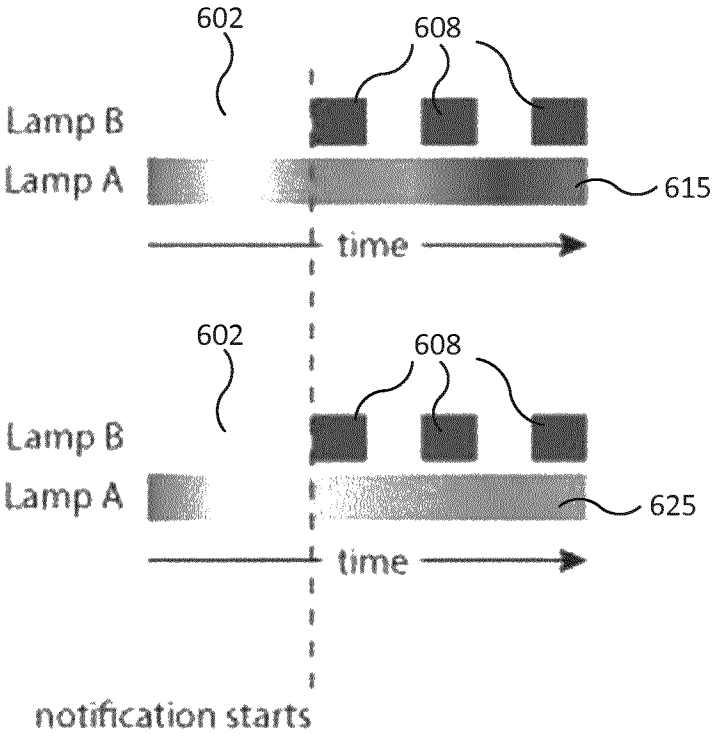

For example, the control module 202 may control light source A 4*a* in accordance with background light settings which define that light source 4*a* should emit light which sequentially cycles through the colours of the rainbow. The background light settings applied to light source A 4*a* may define that light source 4*a* should emit light 615 which slowly fades through the colours of the rainbow (as shown in FIG. 6*a*) or emit light 620 which cycles through discrete colours of the rainbow by transitioning between colour states rapidly with no (or a very short) transition time between colour states (as shown in FIG. 6*b*). The control module 202 may control light source B 4*b* in accordance with background light settings which define that light source B 4*b* should emit yellow light 602 (as shown in FIGS. 6*a* and 6*b*).

The control module 202 may receive, via the network interface 204, notification light settings which assign light source B 4*b* as a notification light source to provide a visual notification of an external event and define light settings to control light source B 4*b* to emit blue light periodically (e.g. to change the colour of the light emitted by light source B 4*b* to blue for a predetermined amount for a period of time and then reverse the colour change for a predetermined period of time, in a repetitive fashion) to provide the visual notification.

In this example, the control module 202 will determine that the colour difference between the colours of light that will be emitted by light source B 4*b* and the colours of light emitted by light source A 4*a* does not provides a sufficient contrast (as light source A 4*a* will also emit blue light as it cycles through the colours of the rainbow), and modify the background light settings applied to light source A 4*a* to reduce the speed at which light source A 4*a* cycles through the rainbow effect when the light source A 4*a* is emitting a colour that contrasts to the blue light emitted by light source B 4*b*. The light emitted by light source A 4*a* in accordance with these modified background light settings is illustrated in FIGS. 6*a* and 6*b* (represented as numerals 625 and 630 in FIGS. 6*a* and 6*b* respectively).

Thus it can be seen for example from FIG. 6*a*, that the control module 202 may modify the light emitted by light source A 4*a* to reduce the speed of the colour fading when the light source A 4*a* emits a colour that contrasts to the blue light emitted by light source B 4*b*. Furthermore, it can be seen for example from FIG. 6*b*, that the control module 202 may modify the light emitted by light source A 4*a* to go from a rapid direct transition between colours to a slow fading transition when the light source A 4*a* emits a colour that contrasts to the blue light emitted by light source B 4*b*.

In embodiments, the control module 202 may determine based on the comparison at step S306 that a temporal characteristic of the received notification light settings is to be modified, and in response, modify the temporal characteristic of the notification light settings to generate the modified notification settings (at step S316) to enhance the contrast between the light emitted by the background light sources and the light emitted by the notification light sources For example, in the above described embodiment whereby the control module 202 controls the light sources 4*a*, 4*b*, 4*c* in accordance with background light settings which define that the light sources 4*a*, 4*b*, 4*c* should emit light to produce a disco effect (e.g. fast flashing and blinking of different colours) whereby the duration of the flashes are 0.5 s each, and receives notification light settings which assign light source 4*c* as a notification light source to provide a visual notification of an external event and define light settings to control light source C 4*c* to emit flashing light whereby the duration of the flashes are also 0.5 s each, the control module 202 may modify the received notification light settings such that the light sources emit flashing light having a longer flash duration e.g. 2.5 s each, In another example, if the control module 202 controls the light sources 4*a*, 4*b*, 4*c* in accordance with background light settings which define that the light sources 4*a*, 4*b*, 4*c* should emit flashing light with sudden flashes e.g. no (or a very short) transition time between on/off states, and receives notification light settings which assign light source 4*c* as a notification light source to provide a visual notification of an external event and define light settings to control light source C 4*c* to also emit flashing light with sudden flashes, the control module 202 may modify the received notification light settings to adjust the transition time between on/off states of the light emitted by the notification light source C 4*c*. For example, instead of the light emitted by the notification light source C 4*c* appearing to be turned on/off, the light emitted by the notification light source C 4*c* would appear more like a siren light, or a light that pulses in accordance with the modified notification light settings.

Various embodiments have been described above which describe how the control module 202 may modify the background light settings and/or the notification light settings. The control module 202 may combine any number of these methods when modifying the background light settings and/or the notification light settings (i.e. enhance brightness, colour contrast, both static or dynamically). For example, in one scenario the control module 202 may modify the dynamic effects and brightness of the background light settings and/or the notification light settings, whereas in another scenario the control module 202 may modify the colour spectrum and brightness of the background light settings and/or the notification light settings.

In the embodiments described above, the control module 202 does not overrule the background light settings that were configured by the user 8 in a definitive way. These background light settings are always the starting point for the adaptation algorithm implemented by the control module 202 such that if the notification stops all light sources may fall back to the original background light settings (the light settings applied to the light sources immediately prior to receipt of the notification light settings).

It will be appreciated that multiple notifications may take place (i.e. notification light settings may be received when one or more light sources are providing a visual notification in accordance with previously received notification light settings). In these scenarios the adaptation algorithm implemented by the control module 202 always take the latest state as the new background value for a new notification. That is, the notification lighting effects can be cascaded such that the notification light settings associated with a first event become the background light settings of a second event and so forth.

The memory 206 may store a map (e.g. a floorplan of a room, building or complex) which includes information about the relative location of light sources coupled to the control unit 200 that are in the environment 2 of the user 8.

In embodiments, the control module 202 may be coupled (via a wired or wireless connection) to sensors that are located in areas of the environment of the user 8 in which the light sources are also located. The sensors may comprise one or more of a passive infra-red sensor, an ultrasound sensor, a radar sensor, an image sensor (e.g. a 2D or 3D/range image sensor) etc.

The map stored in memory 206 includes information about the location of these sensors. The control module 202 is configured to perform motion and/or presence detection based on sensor signals output from the sensors. In response to detection of motion and/or presence of the user 8 based on a sensor output signal from a sensor that is located at a particular location (e.g. room of a house), the control module 202 may modify the received notification light settings such that the light source(s) located at the particular location is used to convey the visual notification associated with an event. By using sensor output signal(s) to render the notification at the light(s) that are close(st) to the user 8, the likelihood of the user 8 perceiving the notification will be increased.

In terms of determining the location of the user 8, the control module 202 may determine the location of the user interface device 6 (and thus the location of the user 8) using a localization technique (described in more detail below). This is just one example method of determining the location of the user 8, other mechanisms may be used e.g. the control module 202 may perform image processing on image data captured by one or more image sensor to determine the location of the user 8.

When using a localization technique, the control module 202 may determine the location of the user interface device 6 with respect to a location network comprising a plurality of wireless reference nodes, in some cases also referred to as anchor nodes. These anchors are wireless nodes whose locations are known a priori, typically being recorded in a location database (in memory 206 or external to the control unit 200) which can be queried by the control module 202 to look up the location of a node. The anchor nodes thus act as reference nodes for localization. Measurements are taken of the signals transmitted between the user interface device 6 and a plurality of anchor nodes, for instance the RSSI (receiver signal strength indicator), ToA (time of arrival) and/or AoA (angle of arrival) of the respective signal. Given such a measurement from three or more nodes, the location of the user interface device 6 may then be determined by the control module 202 relative to the location network using techniques such as trilateration, multilateration or triangulation. Given the relative location of the user interface device 6 and the known locations of the anchor nodes, this in turn allows the location of the user interface device 6 (and thus the user 8) to be determined in more absolute terms, e.g. relative to the map.

The control module 202 may determine the location of the user interface device 6 based on a "fingerprint" of a known environment of the user 8. The fingerprint comprises a set of data points each corresponding to a respective one of a plurality of locations throughout the environment in question. Each data point is generated during a training phase by placing the user interface device 6 at the respective location, taking a measurement of the signals received from or by any reference nodes within range at the respective location (e.g. a measure of signal strength such as RSSI), and storing these measurements in a database along with the coordinates of the respective location. The data point is stored along with other such data points in order to build up a fingerprint of the signal measurements as experienced at various locations within the environment. Once deployed, the control module 202 is configured to compare the signal measurements stored in the fingerprint with signal measurements currently experienced by the user interface device 6 whose location is desired to be known, in order to estimate the location of the user interface device 6 (and thus the user 8) relative to the corresponding coordinates of the points in the fingerprint. For example this may be done by approximating that the user interface device 6 is located at the coordinates of the data point having the closest matching signal measurements, or by interpolating between the coordinates of a subset of the data points having signal measurements most closely matching those currently experienced by the device. The fingerprint can be pre-trained in a dedicated training phase before the fingerprint is deployed, by systematically placing a test device at various different locations in the environment. Alternatively or additionally, the fingerprint can built up dynamically by receiving submissions of signal measurements experienced by the actual devices of actual users in an ongoing training phase.

The reference signals transmitted between the reference nodes and the user interface device 6 are the signals whose measurements are used to determine the location of the user interface device 6.

In a device-centric approach the reference nodes each broadcast a signal and the user interface device 6 listen, detecting one or more of those that are currently found in range and taking a respective signal measurement of each. Each reference node may be configured to broadcast its reference signal repeatedly. The respective measurement taken of the respective reference signal from each detected anchor node may for example comprise a measurement of signal strength (e.g. RSSI), time of flight (ToF), angle of arrival (AoA), and/or any other property that varies with distance or location. In this approach, the control module 202 receives signal measurements for computing the location of the user 8 that are transmitted from the user interface device 6 via the network interface 204.

In a network-centric approach on the other hand, the user interface device 6 broadcasts a reference signal and the reference nodes listen, detecting an instance of the signal at one or more of those nodes that are currently in range. In this case the user interface device 6 may broadcast its reference signal repeatedly. The respective measurement taken of each instance of the reference signal from the user interface device 6 may comprise a measure of signal strength (e.g. RSSI) or time of flight (ToF), angle of arrival (AoA), and/or any other property that varies with distance or location. In this approach, the control module 202 receives signal measurements for computing the location of the user 8 that are transmitted from the one or more of those nodes that are currently in range of the user interface device 6.

The reference signals referred to above may be RF signals (for example using Wi-Fi, ZigBee or Bluetooth, or other such short-range RF technology) or ultrasound signals.

In embodiments, each of the anchor nodes does not take the form of a dedicated, stand-alone anchor node, but rather a unit of another utility that is present in the environment 2 for another purpose, and which is exploited in order to incorporate the additional functionality of an anchor node. In one particularly preferred implementation, each of the anchor nodes is incorporated into a respective luminaire having an RF transceiver such as a Wi-Fi, ZigBee or Bluetooth transceiver for facilitating wireless control of the lighting in the environment 2, and the anchor node functionality is incorporated by exploiting the existence of this RF transceiver to additionally broadcast and/or receive localization beacon signals for an additional purpose of locating the user interface device 6.

Alternatively, each of the anchor nodes takes the form of a dedicated, stand-alone anchor node e.g. incorporated into any of a smoke alarm, a presence sensor and/or light sensor unit, a security alarm, an air-conditioning unit, a ventilation unit, or a heating unit (and each anchor node does not necessarily have to be incorporated into the same type of unit, though they may be). In further alternatives each of the anchor nodes may take the form of a wireless access point (AP) which is already beaconing for another purpose relating to its function as an access point, such as to advertise the availability of its wireless network. In yet further alternatives, the anchor nodes may be dedicated anchor nodes having no other function than localization.

The functionality of the control module 202 referred to above may be implemented in code (software) stored on a memory comprising one or more storage media (e.g. memory 206), and arranged for execution on a processor comprising on or more processing units. The code is configured so as when fetched from the memory and executed on the processor to perform operations in line with embodiments discussed below. Alternatively it is not excluded that some or all of the functionality of the control module 202 is implemented in dedicated hardware circuitry, or configurable hardware circuitry like a field-programmable gate array (FPGA).

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The terms "control module" as used herein generally represent software, firmware, hardware, or a combination thereof. In the case of a software implementation, the control module represents program code that performs specified tasks when executed on a processor (e.g. CPU or CPUs). The program code can be stored in one or more computer readable memory devices. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A control unit for use in a lighting system comprising a plurality of light sources, the plurality of light sources comprising notification light sources and background light sources, the control unit comprising:

an interface for communication with a notification service; and a control module, the control module configured to:

control the plurality of light sources to emit light in accordance with background light settings;

receive, via said interface, notification light settings that are to be supplied to one or more of the plurality of light sources assigned as notification light sources by the notification light settings to provide a visual notification of an event that are transmitted from the notification service;

compare the background light settings with the notification light settings in order to determine, based on a predetermined threshold, whether sufficient contrast will be provided; and determine based on said comparison that one or more of the background light settings for the background light sources and the notification light settings for the notification light sources are to be modified such that the contrast between the background light settings of the background light sources and the notification light settings of the notification light sources is enhanced;

wherein in response to determining that the received notification light settings are to be modified, the control module is configured to modify the received notification light settings to generate modified notification light settings, and control the one or more notification light sources in accordance with the modified notification light settings, and wherein in response to determining that the background light settings are to be modified, the control module is configured to modify the background light settings to generate modified background light settings, and control background light sources of the plurality of light sources in accordance with the modified background light settings.

2. The control unit of claim 1, further comprising a memory storing possible light settings associated with each of the plurality of light sources, and the control module is configured to modify the received notification light settings based on possible light settings associated with the light sources assigned as notification light sources, and modify the background light settings based on possible light settings associated with the background light sources.

3. The control unit of claim 1, wherein the control module is configured to determine based on said comparison that brightness settings of the notification light settings are to be modified, and in response, modify the brightness settings of the notification light settings to generate the modified notification light settings.

4. The control unit of claim 1, wherein the control module is configured to determine based on said comparison that brightness settings of the background light settings are to be modified, and in response, modify the brightness settings of the background light settings to generate the modified background light settings.

5. The control unit of claim 3, wherein the comparison comprises comparing the brightness settings of the background light settings with the brightness settings of the notification light settings.

6. The control unit of claim 1, wherein the control module is configured to determine based on said comparison that static colour settings of the background light settings are to be modified, and in response, modify the static colour settings of the background light settings to generate the modified background light settings.

7. The control unit of claim 6, wherein the comparison comprises a colour spectrum comparison of the static colour settings of the background light settings and colour settings of the notification light settings.

8. The control unit of claim 1, wherein the control module is configured to determine based on said comparison that dynamic colour settings of the background light settings are to be modified, and in response, modify the dynamic colour settings of the background light settings to generate the modified background light settings.

9. The control unit of claim 6, wherein the comparison comprises a colour spectrum comparison of the dynamic colour settings of the background light settings and colour settings of the notification light settings.

10. The control unit of claim 1, wherein the control module is configured to determine based on said comparison that a temporal characteristic of the received notification light settings is to be modified, and in response, modify the temporal characteristic of the notification light settings to generate the modified notification light settings.

11. The control unit of claim 1, wherein the control module is configured to control the one or more notification light sources in accordance with the modified notification light settings and/or the background light sources in accordance with the modified background light settings, for a predetermined period of time, and upon expiry of the predetermined period of time, the control module is configured to control the plurality of background light sources to emit light in accordance with said background light settings.

12. The control unit of claim 1, wherein the control module is configured to control the one or more notification light sources in accordance with the modified notification light settings and/or the background light sources in accordance with the modified background light settings, until an instruction to stop the visual notification is received, and upon receipt of said instruction, the control module is configured to control the plurality of background light sources to emit light in accordance with said background light settings.

13. The control unit of claim 2, wherein the control module is coupled to a plurality of sensors, and the memory stores location information of each of the plurality of light sources and location information of each of the plurality of sensors, wherein the control module is configured to detect presence and/or motion of a user based on a sensor signal output from a sensor of the plurality of sensors, and modify at least one of the received notification light settings and the background light settings in response to said detection.

14. A method for controlling a plurality of light sources of a lighting system comprising, the plurality of light sources comprising notification light sources and background light sources, the method comprising:

receiving notification light settings that are to be supplied to one or more of the plurality of light sources assigned as notification light sources by the notification light settings to provide a visual notification of an event that are transmitted from a notification service;

comparing background light settings with the notification light settings in order to determine, based on a predetermined threshold, whether sufficient contrast will be provided; and determining based on said comparison that one or more of the background light settings and the notification light settings are to be modified such that the contrast between the background light settings and the notification light settings is enhanced;

wherein in response to determining that the received notification light settings are to be modified, the method further comprising modifying the received notification light settings to generate modified notification light settings, and controlling the one or more notification light sources in accordance with the modified notification light settings, and wherein in response to determining that the background light settings are to be modified, the method further comprising modifying the background light settings to generate modified background light settings, and controlling background light sources in accordance with the modified background light settings.

15. A computer program product for controlling a plurality of light sources of a lighting system, the plurality of light sources comprising notification light sources and background light sources, the computer program product comprising code embodied on a non-transitory computer-readable medium and being configured so as when executed on a processor to:

receive notification light settings that are to be supplied to one or more of the plurality of light sources assigned as notification light sources by the notification light settings to provide a visual notification of an event that are transmitted from a notification service;

compare background light settings with the notification light settings in order to determine, based on a predetermined threshold, whether sufficient contrast will be provided; and determine based on said comparison that one or more of the background light settings for the background light sources and the notification light settings for the notification light sources are to be modified such that the contrast between the background light settings of the background light sources and the notification light settings of the notification light sources is enhanced;

wherein in response to determining that the received notification light settings are to be modified, modify the received notification light settings to generate modified notification light settings, and control the one or more notification light sources in accordance with the modified notification light settings, and wherein in response to determining that the background light settings are to be modified, modify the background light settings to generate modified background light settings, and control background light sources in accordance with the modified background light settings.

* * * * *